US012768243B2

(12) United States Patent
Li et al.

(10) Patent No.: US 12,768,243 B2
(45) Date of Patent: Oct. 20, 2026

(54) METHOD AND APPARATUS FOR CONTROLLING TEMPORARY PLUGGING CONSTRUCTION IN PERFORATION BOREHOLES

(71) Applicants: China University of Petroleum (Beijing), Houston, TX (US); STenergy LLC, Houston, TX (US)

(72) Inventors: Ben Li, Beijing (CN); Quanjun Wang, Cypress, TX (US); Hui Li, Beijing (CN)

( * ) Notice: Subject to any disclaimer, the term of this patent is extended or adjusted under 35 U.S.C. 154(b) by 0 days.

(21) Appl. No.: 19/271,778

(22) Filed: Jul. 17, 2025

(65) Prior Publication Data

US 2026/0028893 A1 Jan. 29, 2026

(51) Int. Cl.

| | |
|---|---|
| ***E21B 33/138*** | (2006.01) |
| ***E21B 43/267*** | (2006.01) |
| ***E21B 47/06*** | (2012.01) |
| ***E21B 49/00*** | (2006.01) |

(52) U.S. Cl.

CPC ..... *E21B 33/138* (2013.01); *E21B 43/267* (2013.01); *E21B 47/06* (2013.01); *E21B 49/00* (2013.01); *E21B 2200/20* (2020.05)

(58) Field of Classification Search

CPC ..... E21B 33/138; E21B 47/06; E21B 49/00; E21B 2200/20; E21B 43/267

See application file for complete search history.

(56) References Cited

FOREIGN PATENT DOCUMENTS

| | | | | |
|---|---|---|---|---|
| CN | 111639434 A | * | 9/2020 | ..... G06F 30/20 |
| CN | 113836753 A | * | 12/2021 | ..... E21B 43/261 |

* cited by examiner

*Primary Examiner* — Dany E Akakpo

(57) ABSTRACT

The present application discloses a method and device for controlling perforation plugging operations. The method comprises: acquiring the pre-plugging fracturing fluid displacement and the target diversion pressure for a perforated interval; invoking a plugging ball quantity model to calculate the target number of plugging balls; computing the theoretical diversion pressure based on the post-plugging displacement and ball quantity; adjusting the post-plugging displacement when the theoretical pressure does not exceed the target pressure until it does; performing the plugging operation using the determined ball quantity and adjusted displacement; determining whether the plugging is effective by comparing the bottomhole pressure difference before and after the operation with the target diversion pressure. This method enables accurate determination of the number of plugging balls and fluid displacement after plugging, thereby ensuring that the fracturing operation meets the designed requirements.

11 Claims, 3 Drawing Sheets

METHOD AND APPARATUS FOR CONTROLLING TEMPORARY PLUGGING CONSTRUCTION IN PERFORATION BOREHOLES

TECHNICAL FIELD

The present application relates to the field of petroleum extraction technology, and more particularly to a method and an apparatus for controlling temporary plugging construction in perforation boreholes.

BACKGROUND OF THE INVENTION

As a commonly used extraction technique, horizontal well staged fracturing can effectively enhance the development and production of unconventional oil and gas reservoirs. Currently, the length of the horizontal section of a horizontal well generally ranges from 500 meters to 5000 meters. Due to this length constraint, it is necessary to adopt staged and clustered fracturing processes in horizontal wells to efficiently construct a complex fracture network.

However, due to lithological differences encountered during the drilling of horizontal wells through the reservoir, the brittleness index of the reservoir may vary (for example, factors such as Young's modulus, Poisson's ratio, and natural fractures can all affect the brittleness index). Furthermore, due to geological and tectonic influences, there are significant variations in geomechanical parameters (such as maximum horizontal principal stress, minimum horizontal principal stress, and vertical stress). These factors collectively result in differing fracture initiation pressures among clusters within the same stage. Field microseismic fracture monitoring data indicate that uneven fracture initiation is common during horizontal well staged fracturing, and some perforations may even fail to initiate fractures. To further improve the effectiveness of horizontal well fracturing, a temporary plugging technique at perforations has been proposed. Specifically, degradable plugging balls are used during the fracturing process to block the perforations of fractures that have already initiated, thereby forcing an increase in bottomhole pressure to enhance the initiation efficiency of other perforation fractures within the same stage. The plugging balls are designed to degrade naturally under formation temperature and pressure conditions. After degradation, the previously blocked perforations reopen, facilitating efficient fracture network construction in horizontal wells.

However, there is currently no effective solution for accurately determining the number of temporary plugging balls and the post-plugging fracturing fluid displacement, which are critical for efficiently evaluating the effectiveness of the temporary plugging operation.

SUMMARY OF THE INVENTION

The objective of the present application is to provide a method and an apparatus for controlling temporary plugging construction in perforation boreholes, which can accurately determine the number of temporary plugging balls and the post-plugging fracturing fluid displacement, thereby ensuring that the fracturing operation meets preset requirements.

The method and apparatus for controlling temporary plugging construction in perforation boreholes provided in the present application are implemented as follows:

A control method for temporary plugging construction in perforation boreholes, the method comprising:

acquiring the pre-plugging fracturing fluid displacement, post-plugging fracturing fluid displacement, fracturing fluid density, apparent density of the proppant, sand ratio, and target diversion pressure of a target perforation interval;

retrieving a pre-established model for determining the number of temporary plugging balls for perforation boreholes;

calculating the number of plugging balls, as the target number of plugging balls, based on the pre-plugging and post-plugging fracturing fluid displacements, fracturing fluid density, apparent proppant density, sand ratio, and target diversion pressure, as well as the plugging ball determination model;

calculating the theoretical diversion pressure based on the post-plugging fracturing fluid displacement and the target number of plugging balls;

determining whether the theoretical diversion pressure exceeds the target diversion pressure; if not, adjusting the post-plugging fracturing fluid displacement until the calculated theoretical diversion pressure exceeds the target diversion pressure, and identifying the corresponding displacement as the target post-plugging fracturing fluid displacement;

performing the temporary plugging fracturing operation based on the determined target number of plugging balls and the target post-plugging fracturing fluid displacement.

acquiring the bottomhole pressure at a preset first time point before the temporary plugging operation and the bottomhole pressure at a second time point after the temporary plugging operation;

determining whether the temporary plugging operation is effective by comparing the difference between the bottomhole pressure at the second time point after the temporary plugging operation and the bottomhole pressure at the preset first time point before the temporary plugging operation with the target diversion pressure.

In one embodiment, the model for determining the number of temporary plugging balls for perforation boreholes is expressed as:

$$N = ne^{\left(f_n^{-1} ln\left(\left(\frac{Q_2}{Q_1}\right)^{-f_Q}\left(1-\left(\frac{1.31\times10^{-8}Q_2c_1^2\frac{(\rho_l\rho_{sv}+\rho_{sz}^2\alpha)}{(\rho_{sv}+\rho_{sz}\alpha)}}{c_2^2\left(P_{de}\eta^2n^2d^4(1+\zeta)^4c_1^2-Q_2\frac{(\rho_l\rho_{sv}+\rho_{sz}^2\alpha)}{(\rho_{sv}+\rho_{sz}\alpha)}\right)}\right)^{0.5}\right)\right)}$$

where n is the number of perforations in the target perforation interval, e is the base of the natural logarithm, N is the number of temporary plugging balls, $f_n$ is the plugging coefficient, $f_Q$ is the displacement coefficient, $Q_1$ is the pre-plugging fracturing fluid displacement, $Q_2$ is the post-plugging fracturing fluid displacement, $c_1$ is the perforation geometry coefficient, $c_2$ is the plugging perforation geometry coefficient, pr is the fracturing fluid density, $\rho_{sz}$ is the apparent density of the proppant, $\rho_{sv}$ is the true density of the proppant, $\alpha$ is the sand ratio, $P_{de}$ is the target diversion pressure, $\eta$ is the perforation open-area ratio, $\zeta$ is the perforation expansion ratio, and d is the perforation diameter.

In one embodiment, calculating the theoretical diversion pressure based on the post-plugging fracturing fluid displacement and the target number of plugging balls comprises:

calculating the theoretical diversion pressure according to the following formula:

$$P_{de-Q_2} = \frac{Q_2(\rho_l\rho_{sv}+\rho_{sz}^2\alpha)\left(1.31\times10^{-8}c_1^2\left(c_2\left(1-\left(\frac{Q_2}{Q_1}\right)^{f_Q}\left(\frac{N}{n}\right)^{f_n}\right)\right)^2+1\right)}{\eta^2n^2d^4(1+\zeta)^4c_1^2(\rho_{sv}+\rho_{sz}\alpha)}$$

where: $P_{de\text{-}Q2}$ represents the theoretical diversion pressure; $Q_2$ is the post-plugging fracturing fluid displacement; $\rho_l$ is the density of the fracturing fluid; $\rho_{sz}$ is the apparent density of the proppant; $\rho_{sv}$ is the true density of the proppant; $\alpha$ is the sand ratio; $c_1$ is the geometry coefficient of the perforation hole; $c_2$ is the geometry coefficient of the plugged perforation; $Q_1$ is the pre-plugging fracturing fluid displacement; $f_Q$ is the displacement coefficient; N is the number of temporary plugging balls; n is the number of perforations in the target perforation interval; $f_n$ is the plugging coefficient; $\eta$ is the perforation open-area ratio; $\zeta$ is the perforation expansion ratio; and d is the diameter of the perforation.

In one embodiment, determining whether the temporary plugging operation is effective by comparing the difference between the bottomhole pressure at the second time point after the temporary plugging operation and the bottomhole pressure at the preset first time point before the temporary plugging operation with the target diversion pressure comprises:

in the case where the difference between the bottomhole pressure at the second time point after the temporary plugging operation and the bottomhole pressure at the preset first time point before the temporary plugging operation is greater than or equal to the target diversion pressure, determining that the temporary plugging operation is effective;

in the case where the difference between the bottomhole pressure at the second time point after the temporary plugging operation and the bottomhole pressure at the preset first time point before the temporary plugging operation is less than the target diversion pressure, determining that the temporary plugging operation is ineffective;

in the case where the temporary plugging operation is determined to be ineffective, adjusting the post-plugging fracturing fluid displacement and re-determining the target number of plugging balls and the target post-plugging fracturing fluid displacement until the temporary plugging operation is determined to be effective.

In one embodiment, in the case where the theoretical diversion pressure is not greater than the target diversion pressure, adjusting the post-plugging fracturing fluid displacement comprises:

adjusting the post-plugging fracturing fluid displacement in increments of 10 percent.

In one embodiment, acquiring the bottomhole pressure at the preset first time point before the temporary plugging operation and at the second time point after the temporary plugging operation comprises:

calculating the bottomhole pressure at the preset first time point before the temporary plugging operation according to the following formula:

$$P_{BHP1} = 4.505\times10^{-19}\times\frac{4.973^{-a}10^{-m_2}m_1h_{md}Q_{pupm1}^{2.5-0.25a}\rho_l^{1.25}(\rho_l\rho_{sv}+\rho_{sz}^2\alpha_1)^{m_2}}{d_{tub}^{6-0.75a}k^{0.25}(\rho_{sv}+\rho_{sz}\alpha_1)^{m_2}}+9.8\times10^{-6}\frac{h_{td}(\rho_l\rho_{sv}+\rho_{sz}^2\alpha_1)}{(\rho_{sv}+\rho_{sz}\alpha_1)}$$

where: $P_{BHP1}$ is the bottomhole pressure at the preset first time point before the temporary plugging operation; $Q_{pupm1}$ is the fracturing fluid displacement at the preset first time point before the temporary plugging operation; $m_1$ is the density coefficient of the sand-carrying fluid; $m_2$ is the flow regime coefficient of the sand-carrying fluid; k is the consistency coefficient of the fracturing fluid; $d_{tub}$ is the internal diameter of the fracturing string; $h_{td}$ is the true vertical depth of the fracturing interval; $h_{md}$ is the measured depth of the fracturing interval; $\alpha$ is the flow behavior index of the fracturing fluid; $\rho_l$ is the density of the fracturing fluid; $\rho_{sz}$ is the apparent density of the proppant; $\rho_{sv}$ is the true density of the proppant; $\alpha_1$ is the sand ratio at the preset first time point before the temporary plugging operation;

calculating the bottomhole pressure at the second time point after the temporary plugging operation according to the following formula:

$$P_{BHP2} = 4.505\times10^{-19}\times\frac{4.973^{-a}10^{-m_2}m_1h_{md}Q_{pupm2}^{2.5-0.25a}\rho_l^{1.25}(\rho_l\rho_{sv}+\rho_{sz}^2\alpha_2)^{m_2}}{d_{tub}^{6-0.75a}k^{0.25}(\rho_{sv}+\rho_{sz}\alpha_2)^{m_2}}+9.8\times10^{-6}\frac{h_{td}(\rho_l\rho_{sv}+\rho_{sz}^2\alpha_2)}{(\rho_{sv}+\rho_{sz}\alpha_2)}$$

where $P_{BHP2}$ is the bottomhole pressure at the second time point after the temporary plugging operation; $Q_{pupm2}$ is the fracturing fluid displacement at the second time point after the temporary plugging operation; $\alpha_2$ is the sand ratio at the second time point after the temporary plugging operation.

In one embodiment, the density coefficient and flow regime coefficient of the sand-carrying fluid are determined in the following manner:

taking the proppant used during the fracturing process as the target proppant;

acquiring the type and mesh size of the target proppant;

measuring the bulk density and apparent density of the target proppant based on its type and mesh size;

obtaining the target sand ratio and target displacement;

calculating the sand-carrying fluid density under the target sand ratio based on the bulk density and apparent density of the target proppant;

calculating the frictional gradient based on friction experiments conducted at the target displacement and under the target sand ratio;

fitting the density coefficient and flow regime coefficient of the sand-carrying fluid based on the relationship among the frictional gradient, the sand-carrying fluid density under the target sand ratio, the density coefficient, and the flow regime coefficient.

In one embodiment, calculating the sand-carrying fluid density under the target sand ratio based on the bulk density and apparent density of the target proppant comprises:

calculating the sand-carrying fluid density under the target sand ratio according to the following formula:

$$\rho_{ls-\alpha} = \frac{(\rho_l\rho_{sv}+\rho_{sz}^2\alpha)}{(\rho_{sv}+\rho_{sz}\alpha)}$$

where $\rho_{ls-\alpha}$ is the sand-carrying fluid density;

the frictional gradient is calculated according to the following formula:

$$G_{ls-\alpha} = P/L$$

where $G_{ls-\alpha}$ is the frictional gradient, P is the frictional resistance, and L is the length of the target conduit;

the relationship among the frictional gradient, the sand-carrying fluid density coefficient, the sand-carrying fluid flow regime coefficient, and the sand-carrying fluid density under the target sand ratio is expressed as:

$$G_{ls-\alpha} = m_1 \rho_{ls-\alpha}^{m_2}$$

A control apparatus for temporary plugging construction in perforation boreholes, comprising:

an acquisition module, configured to acquire the pre-plugging fracturing fluid displacement, post-plugging fracturing fluid displacement, fracturing fluid density, apparent density of the proppant, sand ratio, and target diversion pressure of a target perforation interval;

a retrieval module, configured to retrieve a pre-established model for determining the number of temporary plugging balls for perforation boreholes;

a first calculation module, configured to calculate the number of plugging balls, as the target number of plugging balls, based on the pre-plugging and post-plugging fracturing fluid displacements, fracturing fluid density, apparent proppant density, sand ratio, and target diversion pressure, as well as the plugging ball determination model;

a second calculation module, configured to calculate the theoretical diversion pressure based on the post-plugging fracturing fluid displacement and the target number of plugging balls;

an adjustment module, configured to determine whether the theoretical diversion pressure exceeds the target diversion pressure, and if not, to adjust the post-plugging fracturing fluid displacement until the calculated theoretical diversion pressure exceeds the target diversion pressure, and to set the corresponding displacement as the target post-plugging fracturing fluid displacement;

a construction module, configured to perform the temporary plugging fracturing operation based on the determined target number of plugging balls and the target post-plugging fracturing fluid displacement;

a third acquisition module, configured to acquire the bottomhole pressure at a preset first time point before the temporary plugging operation and the bottomhole pressure at a second time point after the temporary plugging operation;

a determination module, configured to determine whether the temporary plugging operation is effective by comparing the difference between the bottomhole pressure at the second time point and that at the preset first time point with the target diversion pressure.

An electronic device, comprising a processor and a memory for storing instructions executable by the processor, wherein the processor executes the instructions to perform the steps of the method described above.

A computer-readable storage medium, on which a computer program or instructions are stored, wherein the program or instructions, when executed by a processor, perform the steps of the method described above.

The control method and apparatus for temporary plugging construction in perforation boreholes provided in the present application utilizes a plugging ball determination model to calculate the target number of plugging balls. Based on the number of plugging balls and the acquired post-plugging fracturing fluid displacement, the theoretical diversion pressure is calculated. If the theoretical diversion pressure does not exceed the target diversion pressure, the post-plugging fracturing fluid displacement is adjusted until the theoretical diversion pressure exceeds the target diversion pressure, thereby obtaining the corresponding target post-plugging fracturing fluid displacement. The effectiveness of the temporary plugging operation is then determined by comparing the difference between the bottomhole pressure after and before the plugging operation with the target diversion pressure. Through the above solution, accurate determination of the number of temporary plugging balls and the post-plugging fracturing fluid displacement can be achieved, enabling the fracturing operation to meet preset requirements and effectively evaluating the pressure-building effect of temporary plugging during fracturing.

DESCRIPTION OF THE DRAWINGS

In order to more clearly illustrate the technical solutions in the embodiments of the present application or in the prior art, the drawings used in the description of the embodiments or the prior art will be briefly introduced below. It is apparent that the drawings described below merely illustrate some embodiments of the present application. For those skilled in the art, other drawings can also be obtained based on these drawings without any creative effort.

SPECIFIC EMBODIMENTS

In order to enable those skilled in the art to better understand the technical solutions of the present application, the following describes the technical solutions of the embodiments of the present application clearly and completely with reference to the accompanying drawings. It is apparent that the described embodiments are merely part of the embodiments of the present application, rather than all of them. Based on the embodiments disclosed herein, all other embodiments obtained by those of ordinary skill in the art without any inventive effort shall fall within the scope of protection of the present application.

To address the problem in existing temporary plugging fracturing techniques at perforations, where the plugging parameters cannot be accurately determined and the pressure-building effect of the plugging after fracturing cannot be effectively evaluated, the embodiments of the present application provide a method for controlling temporary plugging construction in perforation boreholes. Although the method steps or apparatus structures provided in the present application are described in the following embodiments or figures, additional or fewer steps or module units may be included in the method or apparatus based on routine knowledge or without requiring any inventive effort. For steps or structures that are not causally dependent in logic, the execution order of the steps or the structure of the modules is not limited to the description or figures provided in the embodiments. When applied in actual devices or terminal products, the method or modular structure may be implemented sequentially or in parallel (for example, in environments using parallel processors, multithreading, or even distributed processing).

Figure 1:
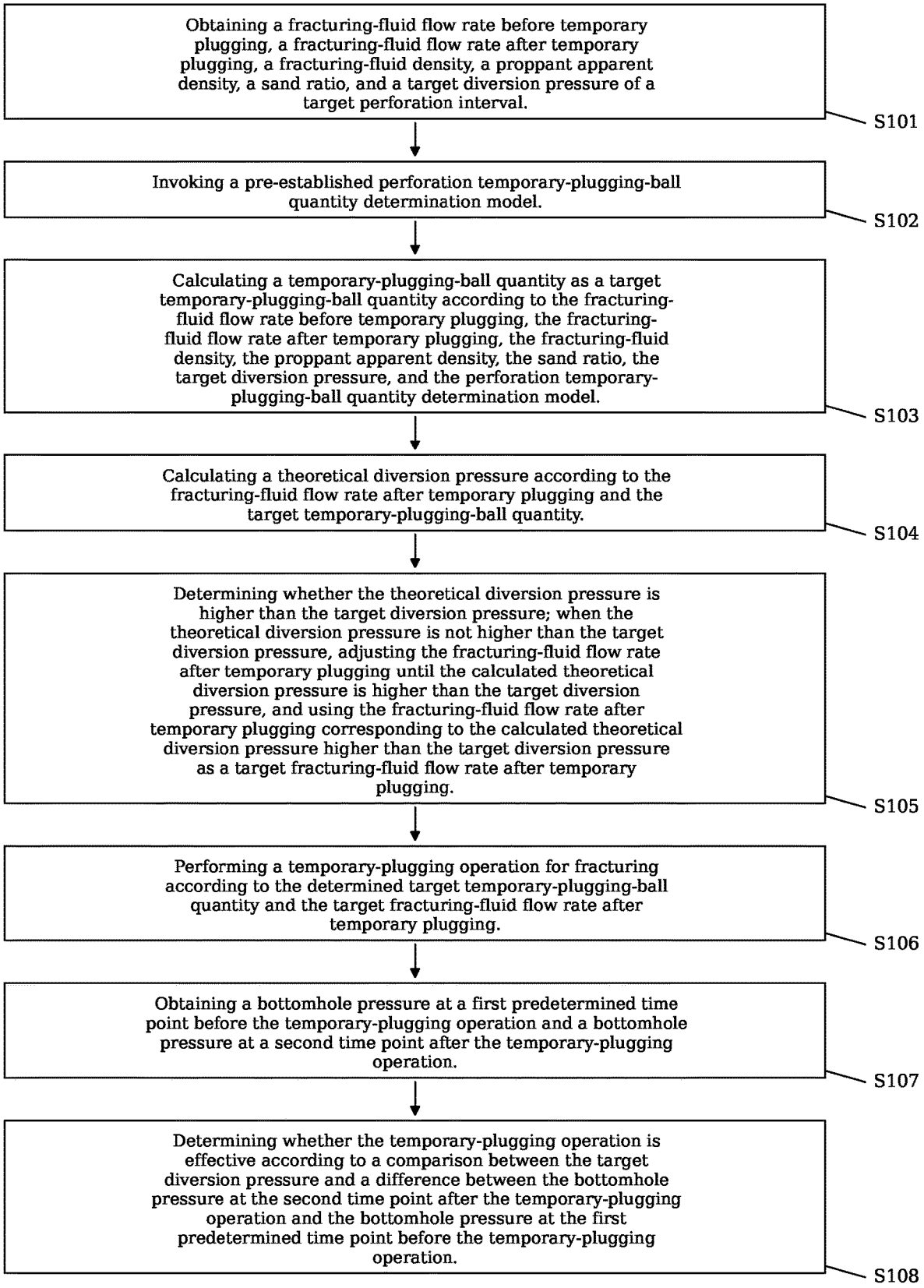
FIG. 1 is a flowchart of a method for controlling temporary plugging construction in perforation boreholes according to an embodiment of the present application.

Specifically, as shown in FIG. 1, the above-described control method for temporary plugging construction in perforation boreholes may include the following steps:

S101: acquiring the pre-plugging fracturing fluid displacement, post-plugging fracturing fluid displacement, fracturing fluid density, apparent density of the proppant, sand ratio, and target diversion pressure of a target perforation interval.

The target diversion pressure may be obtained through single-well geomechanical analysis, and the pre-plugging fracturing fluid displacement may be obtained from the initial fracturing pumping schedule.

S102: retrieving a pre-established model for determining the number of temporary plugging balls for perforation boreholes.

To determine the number of plugging balls, a model for determining the number of temporary plugging balls is provided in this embodiment. The model may be pre-established and stored on a server. When it is necessary to calculate the number of plugging balls, the model may be retrieved from the server and used to calculate and output the number of plugging balls based on the input parameters.

Specifically, the model for determining the number of temporary plugging balls for perforation boreholes may be expressed as:

$$N = ne^{\left(f_n^{-1}\ln\left(\left(\frac{Q_2}{Q_1}\right)^{-f_Q}\left(1-\left(\frac{1.31\times10^{-8}Q_2c_1^2\frac{(\rho_l\rho_{sv}+\rho_{sz}^2\alpha)}{(\rho_{sv}+\rho_{sz}\alpha)}}{c_2^2\left(P_{de}\eta^2n^2d^4(1+\zeta)^4c_1^2-Q_2\frac{(\rho_l\rho_{sv}+\rho_{sz}^2\alpha)}{(\rho_{sv}+\rho_{sz}\alpha)}\right)}\right)^{0.5}\right)\right)}$$

where $\eta$ is the number of perforations in the target perforation interval, e is the base of the natural logarithm, N is the number of temporary plugging balls, $f_n$ is the plugging coefficient, $f_Q$ is the displacement coefficient, $Q_1$ is the pre-plugging fracturing fluid displacement, $Q_2$ is the post-plugging fracturing fluid displacement, $c_1$ is the perforation geometry coefficient, $c_2$ is the plugging perforation geometry coefficient, $\rho_l$ is the fracturing fluid density, $\rho_{sz}$ is the apparent density of the proppant, $\rho_{sv}$ is the true density of the proppant, $\alpha$ is the sand ratio, $\rho_{de}$ is the target diversion pressure, $\eta$ is the perforation open-area ratio, $\zeta$ is the perforation expansion ratio, and d is the perforation diameter.

The perforation geometry coefficient $c_1$, the perforation open-area ratio n, and the perforation expansion ratio $\zeta$ may be obtained through laboratory perforation tests or downhole imaging experiments. The plugging perforation geometry coefficient $c_2$ may be obtained through laboratory experiments involving erosion of perforations by sand-carrying fluid. The plugging coefficient $f_n$ and the displacement coefficient $f_Q$ may be obtained through laboratory experiments of temporary plugging at perforations. However, it should be noted that the methods for determining these parameters as listed above are merely exemplary descriptions and shall not be construed as undue limitations to the present application. In practical implementations, other appropriate methods may be selected according to actual requirements and field conditions, and the present application is not limited thereto.

S103: calculating the number of plugging balls, as the target number of plugging balls, based on the pre-plugging fracturing fluid displacement, post-plugging fracturing fluid displacement, fracturing fluid density, apparent density of the proppant, sand ratio, target diversion pressure of the target perforation interval, and the model for determining the number of temporary plugging balls.

Furthermore, considering that the result calculated by the model for determining the number of temporary plugging balls may be a non-integer, i.e., a decimal value such as 12.3, rounding up may be performed in such cases, and the rounded-up result may be used as the determined number of plugging balls. For example, 12.3 may be rounded up to 13.

S104: calculating the theoretical diversion pressure based on the post-plugging fracturing fluid displacement and the target number of plugging balls.

Considering that the determination of post-plugging fracturing fluid displacement is a process of continuous adjustment, it is necessary to determine the theoretical diversion pressure in order to determine an appropriate value. Based on this, a theoretical diversion pressure calculation model is provided in this embodiment. The calculation model for theoretical diversion pressure may be expressed as:

$$P_{de-Q_2} = \frac{Q_2(\rho_l\rho_{sv}+\rho_{sz}^2\alpha)\left(1.31\times10^{-8}c_1^2\left(c_2\left(1-\left(\frac{Q_2}{Q_1}\right)^{f_Q}\left(\frac{N}{n}\right)^{f_n}\right)\right)^2+1\right)}{\eta^2n^2d^4(1+\zeta)^4c_1^2(\rho_{sv}+\rho_{sz}\alpha)}$$

where: $\rho_{de-Q2}$ represents the theoretical diversion pressure; $Q_2$ is the post-plugging fracturing fluid displacement; $\rho_l$ is the density of the fracturing fluid; $\rho_{sz}$ is the apparent density of the proppant; $\rho_{sv}$ is the true density of the proppant; $\alpha$ is the sand ratio; $c_1$ is the geometry coefficient of the perforation hole; $c_2$ is the geometry coefficient of the plugged perforation; $Q_1$ is the pre-plugging fracturing fluid displacement; $f_Q$ is the displacement coefficient; N is the number of temporary plugging balls; n is the number of perforations in the target perforation interval; $f_n$ is the plugging coefficient; $\eta$ is the perforation open-area ratio; $\zeta$ is the perforation expansion ratio; and d is the diameter of the perforation.

S105: determining whether the theoretical diversion pressure is greater than the target diversion pressure; if the theoretical diversion pressure is not greater than the target diversion pressure, adjusting the post-plugging fracturing fluid displacement until the calculated theoretical diversion pressure exceeds the target diversion pressure, and identifying the corresponding post-plugging fracturing fluid displacement as the target post-plugging fracturing fluid displacement.

Specifically, after calculating the theoretical diversion pressure, it may be compared with the target diversion pressure. It is required that the theoretical diversion pressure be greater than the target diversion pressure. If this requirement is not met, the post-plugging fracturing fluid displacement shall be adjusted. The adjustment may be performed gradually according to a preset proportional value, namely, an adjustment increment. For example, the preset proportion may be 5%, 10%, or 15%. The specific adjustment proportion may be determined based on actual construction conditions or the desired level of accuracy. Through this adjustment process, a final post-plugging fracturing fluid displacement can be determined as the target post-plugging fracturing fluid displacement.

S106: performing the temporary plugging fracturing operation based on the determined target number of plugging balls and the target post-plugging fracturing fluid displacement.

S107: acquiring the bottomhole pressure at a preset first time point before the temporary plugging operation and the bottomhole pressure at a second time point after the temporary plugging operation.

To accurately determine the bottomhole pressure, a bottomhole pressure calculation model is provided in this embodiment. The calculation model may be expressed as:

$$P_{BHP} = 4.505\times10^{-19}\times \frac{4.973^{-a}10^{-m_2}m_1h_{md}Q_{pupm}^{2.5-0.25a}\rho_l^{1.25}(\rho_l\rho_{sv}+\rho_{sz}^2\alpha)^{m_2}}{d_{tub}^{6-0.75a}k^{0.25}(\rho_{sv}+\rho_{sz}\alpha)^{m_2}} + 9.8\times 10^{-6}\frac{h_{td}(\rho_l\rho_{sv}+\rho_{sz}^2\alpha)}{(\rho_{sv}+\rho_{sz}\alpha)}$$

where $P_{BHP}$ is the bottomhole pressure, in units of Mpa; $Q_{pupm}$ is the fracturing fluid displacement, in units of $m^3$/min; $m_1$ is the density coefficient of the sand-carrying fluid; $m_2$ is the flow regime coefficient of the sand-carrying fluid; k is the consistency coefficient of the fracturing fluid, in units of Pa·s; $d_{tub}$ is the internal diameter of the fracturing string, in units of meters (m); $h_{td}$ is the true vertical depth of the fracturing interval, in meters (m); $h_{md}$ is the measured depth of the fracturing interval, in meters (m); $\alpha$ is the flow behavior index of the fracturing fluid; $\rho_l$ is the density of the fracturing fluid; $\rho_{sz}$ is the apparent density of the proppant; $\rho_{sv}$ is the true density of the proppant; $\alpha$ is the sand ratio.

Specifically, the temporary plugging pressure can be calibrated using a temporary plugging pressure curve. The bottomhole pressure before and after plugging can be identified based on the plugging time, where the pre-plugging pressure corresponds to the bottomhole pressure before plugging, and the post-plugging pressure corresponds to the bottomhole pressure after plugging. For the bottomhole pressure at the preset first time point before the temporary plugging operation and the bottomhole pressure at the second time point after the temporary plugging operation, the main differences lie in the fracturing fluid displacement and the sand ratio, as these parameters change before and after plugging. Based on this, the above bottomhole pressure calculation model can be transformed as follows:

calculating the bottomhole pressure at the preset first time point before the temporary plugging operation according to the following formula:

$$P_{BHP1} = 4.505\times10^{-19}\times \frac{4.973^{-a}10^{-m_2}m_1h_{md}Q_{pupm1}^{2.5-0.25a}\rho_l^{1.25}(\rho_l\rho_{sv}+\rho_{sz}^2\alpha_1)^{m_2}}{d_{tub}^{6-0.75a}k^{0.25}(\rho_{sv}+\rho_{sz}\alpha_1)^{m_2}} + 9.8\times 10^{-6}\frac{h_{td}(\rho_l\rho_{sv}+\rho_{sz}^2\alpha_1)}{(\rho_{sv}+\rho_{sz}\alpha_1)}$$

where: $\rho_{BHP1}$ is the bottomhole pressure at the preset first time point before the temporary plugging operation; $Q_{pupm1}$ is the fracturing fluid displacement at the preset first time point before the temporary plugging operation; $m_1$ is the density coefficient of the sand-carrying fluid; $m_2$ is the flow regime coefficient of the sand-carrying fluid; k is the consistency coefficient of the fracturing fluid; $d_{tub}$ is the internal diameter of the fracturing string; $h_{td}$ is the true vertical depth of the fracturing interval; $h_{md}$ is the measured depth of the fracturing interval; $\alpha$ is the flow behavior index of the fracturing fluid; $\rho_l$ is the density of the fracturing fluid; $\rho_{sz}$ is the apparent density of the proppant; $\rho_{sv}$ is the true density of the proppant; $\alpha_1$ is the sand ratio at the preset first time point before the temporary plugging operation;

calculating the bottomhole pressure at the second time point after the temporary plugging operation according to the following formula:

$$P_{BHP2} = 4.505\times10^{-19}\times \frac{4.973^{-a}10^{-m_2}m_1h_{md}Q_{pupm2}^{2.5-0.25a}\rho_l^{1.25}(\rho_l\rho_{sv}+\rho_{sz}^2\alpha_2)^{m_2}}{d_{tub}^{6-0.75a}k^{0.25}(\rho_{sv}+\rho_{sz}a_2)^{m_2}} + 9.8\times 10^{-6}\frac{h_{td}(\rho_l\rho_{sv}+\rho_{sz}^2\alpha_2)}{(\rho_{sv}+\rho_{sz}\alpha_2)}$$

where $\rho_{BHP2}$ is the bottomhole pressure at the second time point after the temporary plugging operation; $Q_{pupm2}$ is the fracturing fluid displacement at the second time point after the temporary plugging operation; $\alpha_2$ is the sand ratio at the second time point after the temporary plugging operation.

In one embodiment, the preset first time point may be five minutes, ten minutes, or fifteen minutes before the temporary plugging operation. Similarly, the second time point after the temporary plugging operation may be five minutes, ten minutes, or fifteen minutes after the operation. The specific time points may be determined according to actual conditions, and the embodiments of this specification are not limited to these values.

S108: determining whether the temporary plugging operation is effective by comparing the difference between the bottomhole pressure at the second time point after the temporary plugging operation and the bottomhole pressure at the preset first time point before the operation with the target diversion pressure.

In one embodiment, when the difference between the bottomhole pressure at the second time point after the temporary plugging operation and the bottomhole pressure at the preset first time point before the operation is greater than or equal to the target diversion pressure, it indicates that the pressure generated by the temporary plugging is sufficient to meet the requirement, and the operation is determined to be effective. When the difference is less than the target diversion pressure, it indicates that the pressure generated by the temporary plugging is insufficient, and the operation is determined to be ineffective. Accordingly, when the operation is determined to be ineffective, the post-plugging fracturing fluid displacement needs to be adjusted, and the target number of plugging balls and the target post-plugging fracturing fluid displacement are recalculated based on the plugging ball determination model and the theoretical diversion pressure calculation model.

Then, using the bottomhole pressure calculation model, the bottomhole pressures at the preset first time point before and the second time point after the temporary plugging operation are recalculated to evaluate whether the operation is effective, and the process is repeated until the operation is confirmed to be effective.

Furthermore, the bottomhole pressure calculation model described above involves two parameters: the density coefficient ($m_1$) and the flow regime coefficient ($m_2$) of the sand-carrying fluid. These coefficients are related to the type of proppant and the particle diameter of the proppant, and must be determined through laboratory or field measurements. A method for determining $m_1$ and $m_2$ is proposed in this embodiment, which may include the following steps:

S1: For a selected type of proppant, such as ceramic proppant or quartz sand, acquiring the mesh size of the proppant, such as 20/40 or 40/70, and the corresponding fracturing fluid system; then measuring the bulk density and apparent density of the proppant, and designing target sand ratios such as 5 percent, 10 percent, and 15 percent.

S2: Based on the bulk density and apparent density of the proppant, calculating the sand-carrying fluid density $\rho_{ls-\alpha}$ under the target sand ratio according to the following formula:

$$\rho_{ls-\alpha} = \frac{(\rho_l \rho_{sv} + \rho_{sz}^2 \alpha)}{(\rho_{sv} + \rho_{sz}\alpha)}$$

where Pts-α is the sand-carrying fluid density under the target sand ratio.

S3: Designing the diameter of the target flow conduit and the target displacement, and measuring the frictional resistance at the target displacement; then, based on friction experiments conducted under the target displacement and target sand ratio, calculating the frictional gradient according to the following formula:

$$G_{ls-\alpha} = P/L$$

where $G_{ls-\alpha}$ is the frictional gradient, P is the frictional resistance, and L is the length of the target flow conduit.

S4: Fitting the density coefficient $m_1$ and the flow regime coefficient $m_2$ of the sand-carrying fluid based on the following relationship among the frictional gradient, the density coefficient, the flow regime coefficient, and the sand-carrying fluid density under the target sand ratio:

$$G_{ls-\alpha} = m_1 \rho_{ls-\alpha}^{m_2}.$$

The following provides a specific embodiment to illustrate the above-described method. However, it should be noted that this specific embodiment is intended solely for better understanding of the present application and shall not be construed as an undue limitation thereof.

In this embodiment, in view of the problems existing in conventional perforation-based temporary plugging fracturing techniques-namely, the inability to accurately determine the number of plugging balls and the post-plugging fracturing fluid displacement, which leads to the inability to accurately evaluate the effectiveness of the plugging design parameters-a design and evaluation model for temporary plugging parameters is proposed.

This model enables more accurate design by taking into account factors such as perforation density, perforation thickness, number of plugging balls, and post-plugging fracturing fluid displacement. It also allows accurate evaluation of the pressure build-up effect after hydraulic fracturing based on parameters such as fracturing fluid displacement, proppant density, and wellhead pump pressure, thereby providing guidance for efficient exploration and production of horizontal wells in unconventional reservoirs such as shale gas and coalbed methane.

Specifically, in this embodiment, a plugging ball quantity design model for perforation boreholes is provided, which is expressed as:

$$N = ne^{\left(f_n^{-1} \ln\left(\left(\frac{Q_2}{Q_1}\right)^{-f_Q}\left(1-\left(\frac{1.31\times10^{-8} Q_2 c_1^2 \frac{(\rho_l \rho_{sv}+\rho_{sz}^2\alpha)}{(\rho_{sv}+\rho_{sz}\alpha)}}{c_2^2\left(P_{de}\eta^2 n^2 d^4 (1+\zeta)^4 c_1^2 - Q_2 \frac{(\rho_l \rho_{sv}+\rho_{sz}^2\alpha)}{(\rho_{sv}+\rho_{sz}\alpha)}\right)}\right)^{0.5}\right)\right)\right)}$$

where η is the number of perforations in the target perforation interval; e is the base of the natural logarithm; N is the number of temporary plugging balls; $f_n$ is the plugging coefficient; $f_Q$ is the displacement coefficient; $Q_1$ is the pre-plugging fracturing fluid displacement, in units of $m^3$/min; $Q_2$ is the post-plugging fracturing fluid displacement, in units of $m^3$/min; $c_1$ is the perforation geometry coefficient, with a value between 0 and 1; $c_2$ is the plugging perforation geometry coefficient, with a value between 0 and 1; pr is the fracturing fluid density, in units of kg/$m^3$; $\rho_{sz}$ is the apparent density of the proppant, in units of kg/$m^3$; $\rho_{sv}$ is the true density of the proppant, in units of kg/$m^3$; α is the sand ratio, $\rho_{de}$ is the target diversion pressure, in units of MPa; η is the perforation open-area ratio, ζ is the perforation expansion ratio, and d is the perforation diameter.

Furthermore, in order to determine the target post-plugging fracturing fluid displacement, it is necessary to calculate the theoretical diversion pressure. Specifically, the theoretical diversion pressure may first be calculated based on the post-plugging fracturing fluid displacement and the target number of plugging balls. Then, it is determined whether the theoretical diversion pressure exceeds the target diversion pressure. If the theoretical diversion pressure does not exceed the target diversion pressure, the post-plugging fracturing fluid displacement is adjusted until the calculated theoretical diversion pressure exceeds the target diversion pressure. The post-plugging fracturing fluid displacement corresponding to the point at which the theoretical diversion pressure exceeds the target diversion pressure is then taken as the target post-plugging fracturing fluid displacement.

In order to calculate the theoretical diversion pressure, a design model for the post-plugging fracturing fluid displacement in perforation-based temporary plugging is provided in this embodiment, which is expressed as follows:

$$P_{de-Q_2} = \frac{Q_2(\rho_l \rho_{sv} + \rho_{sz}^2\alpha)\left(1.31\times10^{-8} c_1^2\left(c_2\left(1-\left(\frac{Q_2}{Q_1}\right)^{f_Q}\left(\frac{N}{n}\right)^{f_n}\right)\right)^2+1\right)}{\eta^2 n^2 d^4 (1+\zeta)^4 c_1^2 (\rho_{sv}+\rho_{sz}\alpha)}$$

where: $\rho_{de-Q2}$ represents the theoretical diversion pressure; $Q_2$ is the post-plugging fracturing fluid displacement; $\rho_l$ is the density of the fracturing fluid; $\rho_{sz}$ is the apparent density of the proppant; $\rho_{sv}$ is the true density of the proppant; α is the sand ratio; $c_1$ is the geometry coefficient of the perforation hole; $c_2$ is the geometry coefficient of the plugged perforation; $Q_1$ is the pre-plugging fracturing fluid displacement; $f_Q$ is the displacement coefficient; N is the number of temporary plugging balls; η is the number of perforations in the target perforation interval; $f_n$ is the plugging coefficient; η is the perforation open-area ratio; ζ is the perforation expansion ratio; and d is the diameter of the perforation.

The perforation geometry coefficient $c_1$, the perforation open-area ratio n, and the perforation expansion ratio $\zeta$ may be obtained from laboratory perforation experiments or from downhole imaging field experiments. The plugging perforation geometry coefficient $c_2$ may be obtained through laboratory experiments involving erosion of perforations by sand-carrying fluid. The plugging coefficient $f_n$ and the displacement coefficient $f_Q$ may be obtained through laboratory experiments of perforation-based temporary plugging.

Based on the post-plugging fracturing fluid displacement design model for perforation-based temporary plugging, the target diversion pressure $\rho_{de}$ may first be obtained from single-well geomechanical analysis. The pre-plugging fracturing fluid displacement $Q_1$ may be obtained from the initial fracturing pump schedule, and a post-plugging fracturing fluid displacement $Q_2$ may be proposed. Then, the number of temporary plugging balls N is calculated using the plugging ball quantity design model. If the calculated number N is a non-integer, it is rounded up to the nearest integer as the final number of plugging balls. Subsequently, the theoretical diversion pressure $\rho_{de\text{-}Q2}$ is calculated using the post-plugging fracturing fluid displacement design model. If $\rho_{de\text{-}Q2}>\rho_{de}$, the designs of the number of plugging balls N and the post-plugging displacement $Q_2$ are considered reasonable. If $\rho_{de\text{-}Q2}\leq P_{de}$, the post-plugging fracturing fluid displacement $Q_2$ is adjusted in increments of 10 percent until the calculated $\rho_{de\text{-}Q2}>\rho_{de}$, thereby determining the appropriate number of plugging balls and post-plugging fracturing fluid displacement.

After the number of temporary plugging balls and the post-plugging fracturing fluid displacement have been determined, the pressure increase effect resulting from perforation-based temporary plugging fracturing may be evaluated. To enable such evaluation of the pressure increase effect, a bottomhole pressure calculation model is provided in this embodiment. This model enables the calculation of the bottomhole pressure at a preset first time point before the temporary plugging operation and the bottomhole pressure at a second time point after the temporary plugging operation. The bottomhole pressure calculation model may be expressed as:

$$P_{BHP} = 4.505\times10^{-19}\times \frac{4.973^{-a}10^{-m_2}m_1 h_{md} Q_{pupm}^{2.5-0.25a}\rho_l^{1.25}(\rho_l\rho_{sv}+\rho_{sz}^2\alpha)^{m_2}}{d_{tub}^{6-0.75a}k^{0.25}(\rho_{sv}+\rho_{sz}a)^{m_2}} + 9.8\times 10^{-6}\frac{h_{td}(\rho_l\rho_{sv}+\rho_{sz}^2\alpha)}{(\rho_{sv}+\rho_{sz}\alpha)}$$

where $P_{BHP}$ IS the bottomhole pressure, in units of Mpa; $Q_{pupm}$ is the fracturing fluid displacement, in units of $m^3$/min; $m_1$ is the density coefficient of the sand-carrying fluid; $m_2$ is the flow regime coefficient of the sand-carrying fluid; k is the consistency coefficient of the fracturing fluid, in units of Pa·s; $d_{tub}$ is the internal diameter of the fracturing string, in units of meters (m); $h_{td}$ is the true vertical depth of the fracturing interval, in meters (m); $h_{md}$ is the measured depth of the fracturing interval, in meters (m); $\alpha$ is the flow behavior index of the fracturing fluid; $\rho_l$ is the density of the fracturing fluid; $\rho_{sz}$ is the apparent density of the proppant; $\rho_{sv}$ is the true density of the proppant; $\alpha$ is the sand ratio.

In practice, the fracturing fluid displacement, proppant ratio, and other relevant parameters may be obtained from the fracturing operation curve. Then, using the above-described bottomhole pressure calculation model, a bottomhole pressure curve may be generated. Based on the bottomhole pressure curve, the bottomhole pressure at 10 minutes before the temporary plugging operation, denoted as $P_{BHP}$-pre, and the bottomhole pressure at 10 minutes after the temporary plugging operation, denoted as $P_{BHP}$-post, may be determined. If $P_{BHP\text{-}post}-P_{BHP\text{-}pre}>P_{de}$, the temporary plugging is determined to be effective. If $P_{BHP\text{-}post}-P_{BHP\text{-}pre}\leq P_{de}$, the temporary plugging is determined to be ineffective, and the number of temporary plugging balls and the post-plugging fracturing fluid displacement need to be re-determined.

Furthermore, in the aforementioned bottomhole pressure calculation model, two parameters are involved: the proppant-laden fluid density coefficient $m_1$ and the proppant-laden fluid flow regime coefficient $m_2$. The coefficients $m_1$ and $m_2$ are related to the type of proppant and the diameter of the proppant particles and must be determined through laboratory or field measurements. To determine the proppant-laden fluid density coefficient $m_1$ and the flow regime coefficient $m_2$, the present embodiment provides a method, which may include the following:

S1: For a specific type of proppant (such as ceramic proppant, quartz sand, or other suitable materials), obtain the mesh size of the proppant (for example, 20/40 or 40/70) and the fracturing fluid system to be used. Then, measure the bulk density and apparent density of the proppant, and design a target proppant concentration (for example, 5%, 10%, or 15%).

S2: Based on the bulk density and apparent density of the proppant, the carrying fluid density under the target proppant concentration $\rho_{ls\text{-}\alpha}$ is calculated according to the following formula:

$$\rho_{ls-\alpha} = \frac{(\rho_l\rho_{sv}+\rho_{sz}^2\alpha)}{(\rho_{sv}+\rho_{sz}\alpha)}$$

where $\rho_{ls\text{-}\alpha}$ is the sand-carrying fluid density under the target sand ratio.

S3: Design the diameter of the target pipeline and the target flow rate, and measure the frictional resistance under the target flow rate. Based on the frictional resistance experiment conducted at the target flow rate and target proppant concentration, calculate the friction gradient according to the following formula:

$$G_{ls-\alpha} = P/L$$

where $G_{ls\text{-}\alpha}$ is the frictional gradient, P is the frictional resistance, and L is the length of the target flow conduit.

S4: According to the following relationship among the friction gradient, the carrying fluid density coefficient, the carrying fluid flow regime coefficient, and the carrying fluid density at the target proppant concentration, perform curve fitting to obtain the carrying fluid density coefficient $m_1$ and the carrying fluid flow regime coefficient $m_2$:

$$G_{ls-\alpha} = m_1\rho_{ls-\alpha}^{m_2}.$$

Figure 2:
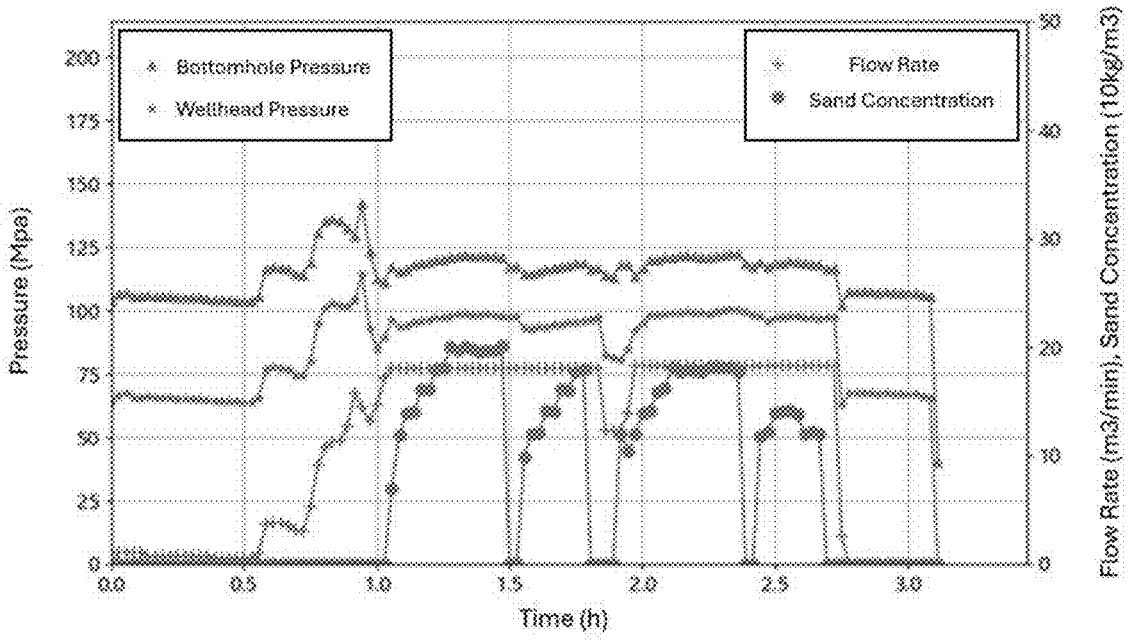
FIG. 2 is a graph showing variation in fracturing operation curves provided in the present application.

Taking a specific example to illustrate the above-mentioned fracturing result, specifically, assume the pressure data are as follows: measured depth of the fracturing interval is 5146 m, true vertical depth of the fracturing interval is 3944 m, internal diameter of the fracturing tubing is 0.1397 m, fracturing fluid density is 1030 kg/m$^3$, proppant bulk density is 1490 kg/m$^3$, and proppant apparent density is 2625 kg/m$^3$. Based on these fracturing parameters, after performing fracturing operations, the time-dependent curves of flow rate, proppant concentration, wellhead pressure, and bottomhole pressure can be shown as in FIG. 2. The bottomhole pressure before and after each fracturing stage can be obtained from the curve shown in FIG. 2, so as to determine the effectiveness of the temporary plugging fracturing.

In the above example, the design of the temporary plugging parameters is more accurate by considering the number of temporary plugging balls based on perforation density and perforation thickness, as well as the post-plugging fracturing fluid displacement. Additionally, the effectiveness of temporary plugging pressure increase after hydraulic fracturing can be accurately evaluated based on parameters such as fracturing fluid displacement, proppant density, and wellhead pump pressure. This provides guidance for efficient exploration and development of unconventional reservoirs such as shale gas and coalbed methane in horizontal wells.

Figure 3:
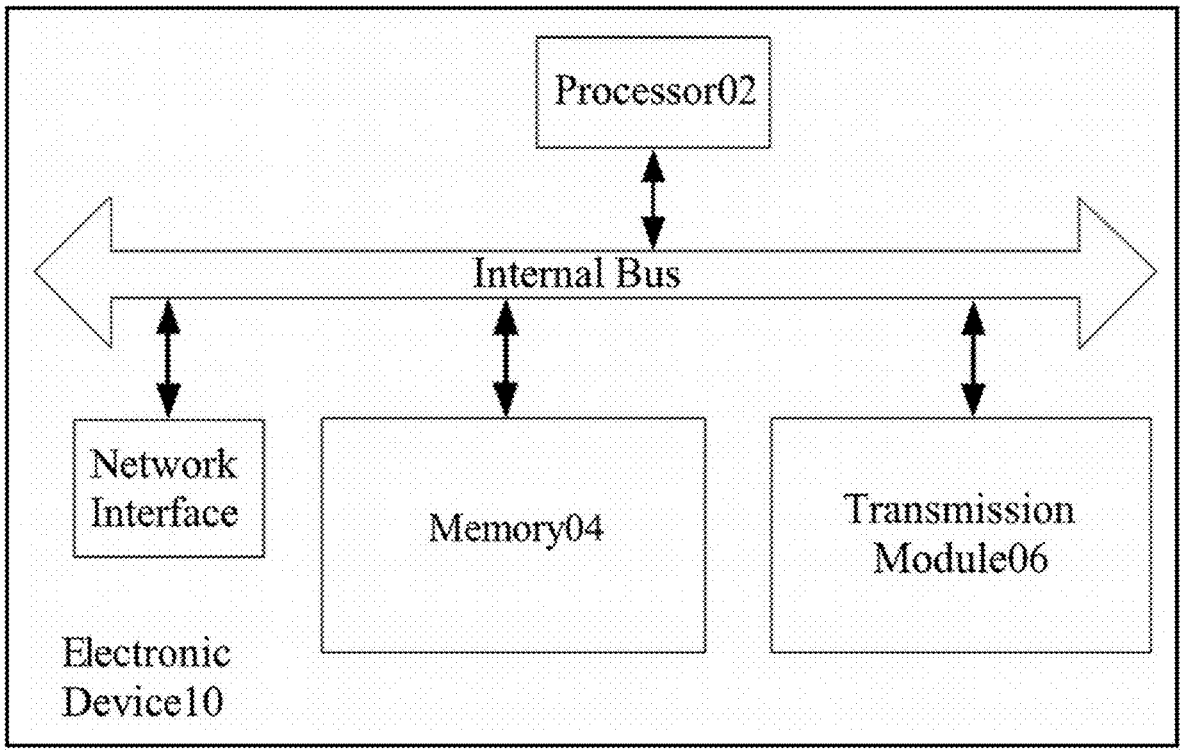
FIG. 3 is a block diagram of a hardware structure of an electronic device for implementing the method for controlling temporary plugging construction in perforation boreholes provided in the present application.

The method provided in the above embodiments of the present application may be executed in mobile terminals, computer terminals, or similar computing devices. Taking execution on an electronic device as an example, FIG. 3 is a hardware block diagram of an electronic device for implementing the control method for temporary plugging construction in perforation tunnels provided by this application. As shown in FIG. 3, the electronic device 10 may include one or more processors 02 (only one is shown in the figure; the processor 02 may include but is not limited to processing devices such as a microcontroller unit (MCU) or a field programmable gate array (FPGA)), a memory 04 for storing data, and a transmission module 06 for communication functionality. It will be understood by those skilled in the art that the structure shown in FIG. 3 is merely illustrative and does not limit the structure of the above electronic device. For example, the electronic device 10 may include more or fewer components than shown in FIG. 3, or may have a different configuration than that shown.

The memory 04 may be used to store software programs and modules of application software, such as the program instructions/modules corresponding to the control method for temporary plugging construction in perforation tunnels as described in the embodiments of the present application. The processor 02 executes the software programs and modules stored in the memory 04 to perform various functional applications and data processing, thereby implementing the control method for temporary plugging construction in perforation tunnels. The memory 04 may include high-speed random access memory and may also include non-volatile memory, such as one or more magnetic storage devices, flash memory, or other non-volatile solid-state storage. In some examples, the memory 04 may further include remote storage relative to the processor 02, which may be connected to the electronic device 10 via a network. Examples of such a network include, but are not limited to, the Internet, intranet, local area network, mobile communication network, and combinations thereof.

The transmission module 06 is used to receive or transmit data via a network. Specific examples of the above network may include a wireless network provided by a communication service provider of the electronic device 10. In one example, the transmission module 06 includes a network interface controller (NIC), which can communicate with the Internet by connecting to other network devices via a base station. In another example, the transmission module 06 may be a radio frequency (RF) module, which is used to communicate with the Internet wirelessly.

Figure 4:
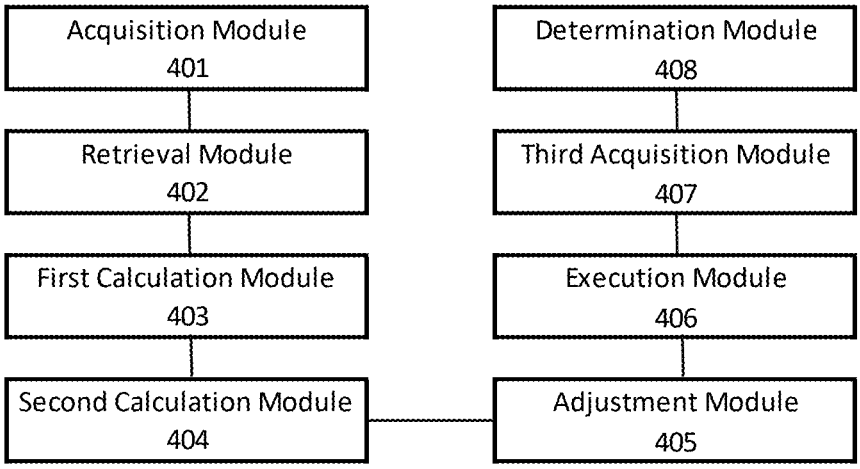
FIG. 4 is a schematic diagram of the module structure of a control apparatus for temporary plugging construction in perforation boreholes according to an embodiment of the present application.

At the software level, the above-mentioned control device for temporary plugging construction in perforation tunnels may include, as shown in FIG. 4:

An acquisition module 401, configured to acquire the pre-plugging fracturing fluid displacement, post-plugging fracturing fluid displacement, fracturing fluid density, apparent density of the proppant, sand ratio, and target diversion pressure for the target perforation segment; A retrieval module 402, configured to retrieve a pre-established model for determining the number of temporary plugging balls;

A first calculation module 403, configured to calculate, based on the pre-plugging and post-plugging fracturing fluid displacements of the target perforation segment, fracturing fluid density, apparent density of the proppant, sand ratio, and target diversion pressure, and the model for determining the number of temporary plugging balls, the number of temporary plugging balls as the target number;

A second calculation module 404, configured to calculate the theoretical diversion pressure based on the post-plugging fracturing fluid displacement and the target number of temporary plugging balls;

An adjustment module 405, configured to determine whether the theoretical diversion pressure is higher than the target diversion pressure, and, if the theoretical diversion pressure is not higher than the target diversion pressure, to adjust the post-plugging fracturing fluid displacement until the calculated theoretical diversion pressure exceeds the target diversion pressure, and to set the fracturing fluid displacement at which the calculated theoretical diversion pressure exceeds the target diversion pressure as the post-plugging target fracturing fluid displacement;

A construction module 406, configured to perform temporary plugging fracturing operations based on the determined target number of temporary plugging balls and the post-plugging target fracturing fluid displacement;

A third acquisition module 407, configured to acquire the bottomhole pressure at a preset first time point before the temporary plugging operation and the bottomhole pressure at a second time point after the temporary plugging operation;

A determination module 408, configured to determine whether the temporary plugging operation is effective based on a comparison between the difference in bottomhole pressure between the second time point after the temporary plugging operation and the preset first time point before the operation, and the target diversion pressure;

In one embodiment, the above-mentioned model for determining the number of temporary plugging balls in perforation tunnels can be expressed as follows:

$$N = ne^{\left(f_n^{-1} \ln\left(\left(\frac{Q_2}{Q_1}\right)^{-f_Q}\left(1-\left(\frac{1.31\times10^{-8} Q_2 c_1^2 \frac{(\rho_l \rho_{sv}+\rho_{sz}^2 \alpha)}{(\rho_{sv}+\rho_{sz}\alpha)}}{c_2^2\left(P_{de}\eta^2 n^2 d^4 (1+\zeta)^4 c_1^2 - Q_2 \frac{(\rho_l \rho_{sv}+\rho_{sz}^2 \alpha)}{(\rho_{sv}+\rho_{sz}\alpha)}\right)}\right)^{0.5}\right)\right)\right)}$$

where η is the number of perforations in the target perforation interval, e is the base of the natural logarithm, N is the number of temporary plugging balls, $f_n$ is the plugging coefficient, $f_Q$ is the displacement coefficient, $Q_1$ is the pre-plugging fracturing fluid displacement, $Q_2$ is the post-plugging fracturing fluid displacement, $c_1$ is the perforation geometry coefficient, $c_2$ is the plugging perforation geometry coefficient, $\rho_l$ is the fracturing fluid density, $\rho_{sz}$ is the apparent density of the proppant, $\rho_{sv}$ is the true density of the proppant, $\alpha$ is the sand ratio, $\rho_{de}$ is the target diversion pressure, $\eta$ is the perforation open-area ratio, $\zeta$ is the perforation expansion ratio, and d is the perforation diameter.

In one embodiment, the second calculation module 404 is specifically configured to calculate the theoretical diversion pressure according to the following equation:

$$P_{de-Q_2} = \frac{Q_2(\rho_l\rho_{sv} + \rho_{sz}^2\alpha)\left(1.31\times10^{-8}c_1^2\left(c_2\left(1-\left(\frac{Q_2}{Q_1}\right)^{f_Q}\left(\frac{N}{n}\right)^{f_n}\right)\right)^2+1\right)}{\eta^2 n^2 d^4(1+\zeta)^4 c_1^2(\rho_{sv}+\rho_{sz}\alpha)}$$

where: $\rho_{de\text{-}Q2}$ represents the theoretical diversion pressure; $Q_2$ is the post-plugging fracturing fluid displacement; $\rho_l$ is the density of the fracturing fluid; $\rho_{sz}$ is the apparent density of the proppant; $\rho_{sv}$ is the true density of the proppant; $\alpha$ is the sand ratio; $c_1$ is the geometry coefficient of the perforation hole; $c_2$ is the geometry coefficient of the plugged perforation; $Q_1$ is the pre-plugging fracturing fluid displacement; $f_Q$ is the displacement coefficient; N is the number of temporary plugging balls; n is the number of perforations in the target perforation interval; $f_n$ is the plugging coefficient; $\eta$ is the perforation open-area ratio; $\zeta$ is the perforation expansion ratio; and d is the diameter of the perforation.

In one embodiment, the determination module 408 is specifically configured to determine that the temporary plugging operation is effective if the difference between the bottom hole pressure at the second time point after the temporary plugging operation and the bottom hole pressure at the preset first time point before the temporary plugging operation is greater than or equal to the target diversion pressure; to determine that the temporary plugging operation is ineffective if the difference is less than the target diversion pressure; and, in the case of an ineffective temporary plugging operation, to adjust the post-plugging fracturing fluid displacement and re-determine the target number of plugging balls and the target post-plugging fracturing fluid displacement until the temporary plugging operation is determined to be effective.

In one embodiment, when the theoretical diversion pressure does not exceed the target diversion pressure, adjusting the post-plugging fracturing fluid displacement may comprise: adjusting the post-plugging fracturing fluid displacement in increments of 10%.

In one embodiment, the third acquisition module 407 is specifically configured to calculate the bottom hole pressure at the preset first time point before the temporary plugging operation according to the following equation:

$$P_{BHP1} = 4.505\times10^{-19}\times\frac{4.973^{-a}10^{-m_2}m_1h_{md}Q_{pupm1}^{2.5-0.25a}\rho_l^{1.25}(\rho_l\rho_{sv}+\rho_{sz}^2\alpha_1)^{m_2}}{d_{tub}^{6-0.75a}k^{0.25}(\rho_{sv}+\rho_{sz}\alpha_1)^{m_2}} + 9.8\times10^{-6}\frac{h_{td}(\rho_l\rho_{sv}+\rho_{sz}^2\alpha_1)}{(\rho_{sv}+\rho_{sz}\alpha_1)}$$

where: $\rho_{BHP1}$ is the bottomhole pressure at the preset first time point before the temporary plugging operation; $Q_{pupm1}$ is the fracturing fluid displacement at the preset first time point before the temporary plugging operation; $m_1$ is the density coefficient of the sand-carrying fluid; $m_2$ is the flow regime coefficient of the sand-carrying fluid; k is the consistency coefficient of the fracturing fluid; $d_{tub}$ is the internal diameter of the fracturing string; $h_{td}$ is the true vertical depth of the fracturing interval; $h_{md}$ is the measured depth of the fracturing interval; $\alpha$ is the flow behavior index of the fracturing fluid; $\rho_l$ is the density of the fracturing fluid; $\rho_{sz}$ is the apparent density of the proppant; $\rho_{sv}$ is the true density of the proppant; $\alpha_1$ is the sand ratio at the preset first time point before the temporary plugging operation;

calculating the bottomhole pressure at the second time point after the temporary plugging operation according to the following formula:

$$P_{BHP2} = 4.505\times10^{-19}\times\frac{4.973^{-a}10^{-m_2}m_1h_{md}Q_{pupm2}^{2.5-0.25a}\rho_l^{1.25}(\rho_l\rho_{sv}+\rho_{sz}^2\alpha_2)^{m_2}}{d_{tub}^{6-0.75a}k^{0.25}(\rho_{sv}+\rho_{sz}\alpha_2)^{m_2}} + 9.8\times10^{-6}\frac{h_{td}(\rho_l\rho_{sv}+\rho_{sz}^2\alpha_2)}{(\rho_{sv}+\rho_{sz}\alpha_2)}$$

where $\rho_{BHP2}$ is the bottomhole pressure at the second time point after the temporary plugging operation; $Q_{pupm2}$ is the fracturing fluid displacement at the second time point after the temporary plugging operation; $\alpha_2$ is the sand ratio at the second time point after the temporary plugging operation.

In one embodiment, the proppant-laden fluid density coefficient and the fluid rheology coefficient can be determined as follows: a proppant used during the fracturing process is selected as the target proppant; the type and mesh size of the target proppant are obtained; based on the type and mesh size of the target proppant, the bulk density and apparent density of the target proppant are measured; the target sand ratio and target flow rate are acquired; the density of the proppant-laden fluid under the target sand ratio is calculated according to the bulk density and apparent density of the target proppant; the friction gradient is calculated through a friction experiment conducted at the target flow rate and target sand ratio; based on the relationship among the friction gradient, the proppant-laden fluid density coefficient, the fluid rheology coefficient, and the density of the proppant-laden fluid under the target sand ratio, the proppant-laden fluid density coefficient and the fluid rheology coefficient are obtained by curve fitting.

In one embodiment, calculating the density of the proppant-laden fluid under the target sand ratio based on the bulk density and apparent density of the target proppant may include:

Calculating the density of the proppant-laden fluid under the target sand ratio according to the following equation:

$$\rho_{ls-\alpha} = \frac{(\rho_l\rho_{sv}+\rho_{sz}^2\alpha)}{(\rho_{sv}+\rho_{sz}\alpha)}$$

where $\rho_{ls\text{-}\alpha}$ is the sand-carrying fluid density under the target sand ratio.

The friction gradient can be calculated according to the following equation:

$$G_{ls-\alpha} = P/L$$

where $G_{ls-\alpha}$ is the frictional gradient, P is the frictional resistance, and L is the length of the target flow conduit.

The relationship among the friction gradient, the sand-laden fluid density coefficient, the sand-laden fluid rheological coefficient, and the sand-laden fluid density under the target sand ratio can be expressed as:

$$G_{ls-\alpha} = m_1 \rho_{ls-\alpha}^{m_2}.$$

An embodiment of the present application further provides a specific implementation of an electronic device capable of executing all the steps of the control method for perforation-based temporary plugging fracturing described in the above embodiments. The electronic device specifically includes: a processor, a memory, a communications interface, and a bus. The processor, the memory, and the communications interface communicate with each other via the bus. The processor is configured to invoke a computer program stored in the memory. When the processor executes the computer program, all the steps of the control method for perforation-based temporary plugging fracturing in the above embodiments are implemented. For example, when executing the computer program, the processor performs the following steps:

Step 1: Acquiring the pre-plugging fracturing fluid displacement, post-plugging fracturing fluid displacement, fracturing fluid density, apparent density of proppant, sand ratio, and target diversion pressure for the target perforated interval;

Step 2: Retrieving a pre-established model for determining the number of temporary plugging balls for perforation;

Step 3: Calculating the number of temporary plugging balls, based on the pre- and post-plugging fracturing fluid displacement of the target perforated interval, the fracturing fluid density, apparent density of proppant, sand ratio, target diversion pressure, and the model for determining the number of temporary plugging balls, and taking the result as the target number of temporary plugging balls;

Step 4: Calculating a theoretical diversion pressure based on the post-plugging fracturing fluid displacement and the target number of temporary plugging balls;

Step 5: Determining whether the theoretical diversion pressure is higher than the target diversion pressure; if the theoretical diversion pressure is not higher than the target diversion pressure, adjusting the post-plugging fracturing fluid displacement until the calculated theoretical diversion pressure exceeds the target diversion pressure, and using the post-plugging fracturing fluid displacement corresponding to the condition where the theoretical diversion pressure exceeds the target diversion pressure as the post-plugging target fracturing fluid displacement;

Step 6: Performing temporary plugging fracturing operation based on the determined target number of temporary plugging balls and the post-plugging target fracturing fluid displacement;

Step 7: Acquiring the bottom hole pressure at a preset first time point before the temporary plugging operation and at a second time point after the temporary plugging operation;

Step 8: Determining whether the temporary plugging operation is effective based on a comparison between the difference in bottom hole pressure between the second time point after temporary plugging and the preset first time point before temporary plugging and the target diversion pressure.

An embodiment of the present application further provides a computer-readable storage medium for implementing all the steps of the above-described control method for perforation-based temporary plugging fracturing. The computer-readable storage medium stores a computer program which, when executed by a processor, implements all the steps of the control method described in the above embodiments. For example, when the processor executes the computer program, it performs the following steps:

Step 1: Acquiring the pre-plugging fracturing fluid displacement, post-plugging fracturing fluid displacement, fracturing fluid density, apparent density of proppant, sand ratio, and target diversion pressure for the target perforated interval;

Step 2: Retrieving a pre-established model for determining the number of temporary plugging balls for perforation;

Step 3: Calculating the number of temporary plugging balls, based on the pre- and post-plugging fracturing fluid displacement of the target perforated interval, the fracturing fluid density, apparent density of proppant, sand ratio, target diversion pressure, and the model for determining the number of temporary plugging balls, and taking the result as the target number of temporary plugging balls;

Step 4: Calculating a theoretical diversion pressure based on the post-plugging fracturing fluid displacement and the target number of temporary plugging balls;

Step 5: Determining whether the theoretical diversion pressure is higher than the target diversion pressure; if the theoretical diversion pressure is not higher than the target diversion pressure, adjusting the post-plugging fracturing fluid displacement until the calculated theoretical diversion pressure exceeds the target diversion pressure, and using the post-plugging fracturing fluid displacement corresponding to the condition where the theoretical diversion pressure exceeds the target diversion pressure as the post-plugging target fracturing fluid displacement;

Step 6: Perform the fracturing diversion operation according to the determined target number of diversion balls and the post-diversion target fracturing fluid displacement.

Step 7: Acquire the bottomhole pressure at the preset first time point before the diversion operation and the bottomhole pressure at the second time point after the diversion operation. Step 8: Determine whether the diversion operation is effective by comparing the difference between the bottomhole pressure at the second time point after the diversion operation and the bottomhole pressure at the preset first time point before the diversion operation with the target steering pressure.

From the above description, it can be understood that the embodiment of the present application calculates the target number of diversion balls through the perforation diversion ball number determination model. Based on the number of diversion balls and the acquired post-diversion fracturing fluid displacement, the theoretical steering pressure is calculated. If the theoretical steering pressure does not exceed the target steering pressure, the post-diversion fracturing fluid displacement is adjusted until the theoretical steering pressure exceeds the target steering pressure, and the corresponding post-diversion fracturing fluid displacement is obtained. The effectiveness of the diversion operation is determined by comparing the difference between the bottomhole pressures before and after the diversion with the target steering pressure. Through this scheme, the number of perforation diversion balls and the post-diversion fracturing fluid displacement can be accurately determined, thereby ensuring that the fracturing operation meets the preset requirements and effectively evaluating the diversion pressurization effect.

Each embodiment in this specification is described in a progressive manner, and the identical or similar parts among the various embodiments are mutually referred to. Each embodiment focuses on the differences from the other embodiments. In particular, for hardware plus software program embodiments, since they are generally similar to method embodiments, the description is relatively simplified. Relevant parts can be referred to in the method embodiments.

The specific embodiments described in this specification are merely illustrative. Other embodiments are within the scope of the claims. In some cases, the actions or steps described in the claims may be performed in a different order than described in the embodiments and still achieve the desired result. Additionally, the processes depicted in the figures do not necessarily require the illustrated specific or sequential order to achieve the intended results. In certain embodiments, multitasking and parallel processing are possible and may even be advantageous.

Although the present application provides method steps as described in the embodiments or flow diagrams, conventional or non-innovative modifications may include more or fewer steps. The order of steps listed in the embodiments is merely one of many possible sequences and is not intended to be the only execution sequence. In practice, the devices or client products may execute according to the method order shown in the embodiments or drawings, or may execute in parallel (for example, in environments with parallel processors or multithreaded processing).

Although the embodiments of this specification provide method steps as described in the embodiments or flow diagrams, it is possible, based on routine or non-innovative means, to include more or fewer steps. The step sequence listed in the embodiments is merely one of many possible sequences and does not represent the only execution order. In actual implementations of devices or terminal products, the method can be executed in the order shown in the embodiments or drawings or executed in parallel (for example, in environments with parallel processors, multithreaded processing, or even distributed data processing). The terms "comprise," "include," or any variation thereof are intended to cover non-exclusive inclusion, such that a process, method, product, or device that includes a series of elements not only includes those elements but may also include other elements not explicitly listed or inherent to such process, method, product, or device. Without further limitations, elements not listed explicitly are not excluded from the process, method, product, or device that includes the specified elements.

For convenience of description, the above-mentioned devices are described by function modules. Of course, when implementing the embodiments of this specification, the functions of each module can be realized in one or more pieces of software and/or hardware. It is also possible for a module implementing the same function to be realized by a combination of multiple submodules or subunits. The device embodiments described above are merely illustrative. For example, the division of the modules is merely a logical functional division. In actual implementation, different divisions may be possible. For example, multiple units or components may be combined or integrated into another system, or some features may be omitted or not implemented. Furthermore, the couplings or direct couplings or communication connections shown or discussed between each other may be indirect couplings or communication connections through some interfaces, devices, or units, which may be electrical, mechanical, or other forms.

It is also known to those skilled in the art that, in addition to implementing the controller through purely computer-readable program code, the same functions can be realized by logically programming the method steps, such that the controller may be implemented in the form of logic gates, switches, application-specific integrated circuits, programmable logic controllers, and embedded microcontrollers. Therefore, such a controller can be regarded as a hardware component, and the internal devices used to implement various functions can also be considered as structures within the hardware component. Alternatively, the devices for realizing various functions can be considered as both software modules implementing the method and structures within the hardware component.

The present application is described with reference to flowcharts and/or block diagrams of methods, apparatuses (systems), and computer program products according to embodiments of the present application. It should be understood that each process and/or block in the flowcharts and/or block diagrams, and combinations of processes and/or blocks in the flowcharts and/or block diagrams, can be implemented by computer program instructions. These computer program instructions may be provided to a processor of a general-purpose computer, special-purpose computer, embedded processor, or other programmable data processing apparatus to produce a machine, such that the instructions executed by the processor of the computer or other programmable data processing apparatus create means for implementing the functions specified in the process or processes and/or block or blocks in the flowcharts and/or block diagrams.

It should be understood by those skilled in the art that the embodiments of this specification may be provided as a method, system, or computer program product. Therefore, the embodiments of this specification may adopt a fully hardware implementation, a fully software implementation, or an implementation combining software and hardware. Moreover, the embodiments of this specification may take the form of a computer program product stored on a computer-usable storage medium containing computer-usable program code, including but not limited to disk storage, CD-ROM, optical storage, and the like.

The embodiments of this specification can be described in the general context of computer-executable instructions executed by a computer, such as program modules. Generally, program modules include routines, programs, objects, components, data structures, and so forth that perform particular tasks or implement particular abstract data types. The embodiments of this specification can also be practiced in distributed computing environments where tasks are performed by remote processing devices that are linked through a communications network. In a distributed computing environment, program modules may be located in both local and remote computer storage media, including memory storage devices.

Each embodiment in this specification is described in a progressive manner, and the identical or similar parts among the various embodiments are mutually referred to. Each embodiment focuses on the differences from the other embodiments. In particular, for system embodiments, since they are generally similar to method embodiments, the description is relatively simplified. Relevant parts can be referred to in the method embodiments. In this specification, terms such as "one embodiment," "some embodiments," "examples," "specific examples," or "some examples" indicate that specific features, structures, materials, or characteristics described in connection with the embodiment or example are included in at least one embodiment or example of the present specification. The schematic representations of these terms are not necessarily referring to the same embodiment or example. Furthermore, the specific features, structures, materials, or characteristics described may be combined in any suitable manner in one or more embodiments or examples. Moreover, without conflict, different embodiments or examples and features described in different embodiments or examples in this specification can be combined.

The above descriptions are merely illustrative of the embodiments of this specification and are not intended to limit the embodiments of this specification. Those skilled in the art will appreciate that various modifications and changes can be made to the embodiments of this specification. Any modifications, equivalent substitutions, improvements, and the like made within the spirit and principles of the embodiments of this specification shall fall within the scope of the claims of this specification.

The invention claimed is:

1. A control method for temporary plugging construction in perforation boreholes, the method comprising:

acquiring, for a target perforation interval, a pre-plugging fracturing fluid displacement, a post-plugging fracturing fluid displacement, a fracturing fluid density, an apparent density of a proppant, a sand ratio, and a target diversion pressure;

retrieving a pre-established model for determining a number of temporary plugging balls for perforation boreholes;

calculating, based on the pre-plugging fracturing fluid displacement, the post-plugging fracturing fluid displacement, the fracturing fluid density, the apparent density of the proppant, the sand ratio, the target diversion pressure, and the pre-established model, a target number of temporary plugging balls;

calculating a theoretical diversion pressure based on the post-plugging fracturing fluid displacement and the target number of temporary plugging balls;

determining whether the theoretical diversion pressure is greater than the target diversion pressure;

in response to determining that the theoretical diversion pressure is not greater than the target diversion pressure, adjusting the post-plugging fracturing fluid displacement until the theoretical diversion pressure exceeds the target diversion pressure, and determining a corresponding adjusted post-plugging fracturing fluid displacement as a target post-plugging fracturing fluid displacement;

performing a temporary plugging fracturing operation for the target perforation interval by injecting the target number of temporary plugging balls and pumping the target post-plugging fracturing fluid displacement;

acquiring a bottomhole pressure at a preset first time before the temporary plugging fracturing operation and a bottomhole pressure at a second time after the temporary plugging fracturing operation; and determining whether the temporary plugging fracturing operation is effective by comparing a difference between the bottomhole pressure at the second time and the bottomhole pressure at the preset first time with the target diversion pressure.

2. The method according to claim 1, wherein the pre-established model for determining the target number of temporary plugging balls for perforation boreholes is expressed as:

$$N = ne^{\left(f_n^{-1} \ln\left(\left(\frac{Q_2}{Q_1}\right)^{-f_Q}\left(1-\left(\frac{1.31\times10^{-8}Q_2c_1^2\frac{(\rho_l\rho_{sv}+\rho_{sz}^2\alpha)}{(\rho_{sv}+\rho_{sz}\alpha)}}{c_2^2\left(P_{de}\eta^2n^2d^4(1+\zeta)^4c_1^2-Q_2\frac{(\rho_l\rho_{sv}+\rho_{sz}^2\alpha)}{(\rho_{sv}+\rho_{sz}\alpha)}\right)}\right)^{0.5}\right)\right)\right)}$$

where n is the number of perforations in the target perforation interval, e is the base of the natural logarithm, N is the number of temporary plugging balls, $f_n$ is the plugging coefficient, $f_Q$ is the displacement coefficient, $Q_1$ is the pre-plugging fracturing fluid displacement, $Q_2$ is the post-plugging fracturing fluid displacement, $c_1$ is the perforation geometry coefficient, $c_2$ is the plugging perforation geometry coefficient, $\rho_1$ is the fracturing fluid density, $\rho_{sz}$ is the apparent density of the proppant, $\rho_{sy}$ is the true density of the proppant, $\alpha$ is the sand ratio, $p_{de}$ is the target diversion pressure, $\eta$ is the perforation open-area ratio, $\zeta$ is the perforation expansion ratio, and d is the perforation diameter.

3. The method according to claim 1, wherein calculating the theoretical diversion pressure based on the post-plugging fracturing fluid displacement and the target number of temporary plugging balls comprises:

calculating the theoretical diversion pressure according to the following equation:

$$P_{de-Q_2} = \frac{Q_2(\rho_l\rho_{sv}+\rho_{sz}^2\alpha)\left(1.31\times10^{-8}c_1^2\left(c_2\left(1-\left(\frac{Q_2}{Q_1}\right)^{f_Q}\left(\frac{N}{n}\right)^{f_n}\right)\right)^2+1\right)}{\eta^2n^2d^4(1+\zeta)^4c_1^2(\rho_{sv}+\rho_{sz}\alpha)}$$

where $P_{de-Q_2}$ represents the theoretical diversion pressure; $Q_2$ is the post-plugging fracturing fluid displacement; $\rho_l$ is the density of the fracturing fluid; $\rho_{sz}$ is the apparent density of the proppant; $\rho_{sy}$ is the true density of the proppant; $\alpha$ is the sand ratio; $c_1$ is the geometry coefficient of the perforation hole; $c_2$ is the geometry coefficient of the plugged perforation; $Q_1$ is the pre-plugging fracturing fluid displacement; $f_Q$ is the displacement coefficient; N is the number of temporary plugging balls; n is the number of perforations in the target perforation interval; $f_n$ is the plugging coefficient; $\eta$ is the perforation open-area ratio; $\zeta$ is the perforation expansion ratio; and d is the diameter of the perforation.

4. The method according to claim 1, wherein determining whether the temporary plugging fracturing operation is effective comprises:

in response to determining that the difference between the bottomhole pressure at the second time and the bottomhole pressure at the preset first time is greater than or equal to the target diversion pressure, determining that the temporary plugging fracturing operation is effective;

in response to determining that the difference between the bottomhole pressure at the second time and the bottomhole pressure at the preset first time is less than the target diversion pressure, determining that the temporary plugging fracturing operation is ineffective; and in response to determining that the temporary plugging fracturing operation is ineffective, adjusting the post-plugging fracturing fluid displacement and re-determining the target number of temporary plugging balls and the target post-plugging fracturing fluid displacement until the temporary plugging fracturing operation is determined to be effective.

5. The method according to claim 1, wherein adjusting the post-plugging fracturing fluid displacement comprises:

adjusting the post-plugging fracturing fluid displacement in increments of 10 percent.

6. The method according to claim 1, wherein acquiring the bottomhole pressure at the preset first time before the temporary plugging fracturing operation and the bottomhole pressure at the second time after the temporary plugging fracturing operation comprises:

calculating the bottomhole pressure at the preset first time before the temporary plugging fracturing operation according to the following formula:

$$P_{BHP1} = 4.505\times10^{-19}\times\frac{4.973^{-a}10^{-m_2}m_1h_{md}Q_{pupm1}^{2.5-0.25a}\rho_l^{1.25}(\rho_l\rho_{sv}+\rho_{sz}^2\alpha_1)^{m_2}}{d_{tub}^{6-0.75a}k^{0.25}(\rho_{sv}+\rho_{sz}\alpha_1)^{m_2}}+9.8\times10^{-6}\frac{h_{td}(\rho_l\rho_{sv}+\rho_{sz}^2\alpha_1)}{(\rho_{sv}+\rho_{sz}\alpha_1)}$$

where: $P_{BHP1}$ is the bottomhole pressure at the preset first time point before the temporary plugging fracturing operation; $Q_{pupm1}$ is the fracturing fluid displacement at the preset first time point before the temporary plugging fracturing operation; $m_1$ is the density coefficient of the sand-carrying fluid; $m_2$ is the flow regime coefficient of the sand-carrying fluid; k is the consistency coefficient of the fracturing fluid; $d_{tub}$ is the internal diameter of a fracturing string; $h_{td}$ is the true vertical depth of the fracturing interval; $h_{md}$ is the measured depth of the fracturing interval; $\alpha$ is the flow behavior index of the fracturing fluid; $\rho_l$ is the density of the fracturing fluid; $\rho_{sz}$ is the apparent density of the proppant; $\rho_{sy}$ is the true density of the proppant; $\alpha_1$ is the sand ratio at the preset first time point before the temporary plugging fracturing operation;

calculating the bottomhole pressure at the second time after the temporary plugging fracturing operation according to the following formula:

$$P_{BHP2} = 4.505\times10^{-19}\times\frac{4.973^{-a}10^{-m_2}m_1h_{md}Q_{pupm2}^{2.5-0.25a}\rho_l^{1.25}(\rho_l\rho_{sv}+\rho_{sz}^2\alpha_2)^{m_2}}{d_{tub}^{6-0.75a}k^{0.25}(\rho_{sv}+\rho_{sz}\alpha_2)^{m_2}}+9.8\times10^{-6}\frac{h_{td}(\rho_l\rho_{sv}+\rho_{sz}^2\alpha_2)}{(\rho_{sv}+\rho_{sz}\alpha_2)}$$

where $P_{BHP2}$ is the bottomhole pressure at the second time point after the temporary plugging fracturing operation; $Q_{pupm2}$ is the fracturing fluid displacement at the second time point after the temporary plugging fracturing operation; $\alpha_2$ is the sand ratio at the second time point after the temporary plugging fracturing operation.

7. The method according to claim 6, wherein the density coefficient and the flow regime coefficient of the sand-carrying fluid are determined by:

taking a proppant used during the temporary plugging fracturing operation as a target proppant;

acquiring a type and a mesh size of the target proppant;

measuring a bulk density and an apparent density of the target proppant based on the type and the mesh size of the target proppant;

obtaining a target sand ratio and a target displacement;

calculating a sand-carrying fluid density under the target sand ratio based on the bulk density and the apparent density of the target proppant;

calculating a frictional gradient based on friction experiments conducted at the target displacement and under the target sand ratio; and fitting the density coefficient and the flow regime coefficient of the sand-carrying fluid based on a relationship among the frictional gradient, the sand-carrying fluid density under the target sand ratio, the density coefficient, and the flow regime coefficient of the sand-carrying fluid.

8. The method according to claim 7, wherein calculating the sand-carrying fluid density under the target sand ratio based on the bulk density and the apparent density of the target proppant comprises:

calculating the sand-carrying fluid density under the target sand ratio according to the following formula:

$$\rho_{ls-\alpha} = \frac{(\rho_l\rho_{sv}+\rho_{sz}^2\alpha)}{(\rho_{sv}+\rho_{sz}\alpha)}$$

where $\rho_{ls-\alpha}$ is the sand-carrying fluid density;

the frictional gradient is calculated according to the following formula:

$$G_{ls-\alpha} = P/L$$

where $G_{ls-\alpha}$ is the frictional gradient, P is the frictional resistance, and L is the length of the target conduit;

the relationship among the frictional gradient, the sand-carrying fluid density coefficient, the sand-carrying fluid flow regime coefficient, and the sand-carrying fluid density under the target sand ratio is expressed by the following formula:

$$G_{ls-\alpha} = m_1\rho_{ls-\alpha}^{m_2}.$$

9. A control apparatus for temporary plugging construction in perforation boreholes, comprising:

one or more processors; and one or more non-transitory computer-readable storage media storing instructions that, when executed by the one or more processors, cause the apparatus to:

acquire, for a target perforation interval, a pre-plugging fracturing fluid displacement, a post-plugging fracturing fluid displacement, a fracturing fluid density, an apparent density of a proppant, a sand ratio, and a target diversion pressure;

retrieve a pre-established model for determining a number of temporary plugging balls for perforation boreholes;

calculate, based on the pre-plugging fracturing fluid displacement, the post-plugging fracturing fluid displacement, the fracturing fluid density, the apparent density of the proppant, the sand ratio, the target diversion pressure, and the pre-established model, a target number of temporary plugging balls;

calculate a theoretical diversion pressure based on the post-plugging fracturing fluid displacement and the target number of temporary plugging balls;

determine whether the theoretical diversion pressure exceeds the target diversion pressure;

in response to determining that the theoretical diversion pressure does not exceed the target diversion pressure, adjust the post-plugging fracturing fluid displacement until the theoretical diversion pressure exceeds the target diversion pressure, and determine a corresponding adjusted post-plugging fracturing fluid displacement as a target post-plugging fracturing fluid displacement;

perform a temporary plugging fracturing operation for the target perforation interval by injecting the target number of temporary plugging balls and pumping the target post-plugging fracturing fluid displacement;

acquire a bottomhole pressure at a preset first time before the temporary plugging fracturing operation and a bottomhole pressure at a second time after the temporary plugging fracturing operation; and determine whether the temporary plugging fracturing operation is effective by comparing a difference between the bottomhole pressure at the second time and the bottomhole pressure at the preset first time with the target diversion pressure.

10. An electronic device, comprising one or more processors and a memory storing instructions that, when executed by the one or more processors, cause the electronic device to perform the method according to any one of claims 1-8.

11. A non-transitory computer-readable storage medium storing instructions that, when executed by one or more processors, cause the one or more processors to perform the method according to any one of claims 1-8.

* * * * *